US007265733B1

(12) United States Patent
Tsai et al.

(10) Patent No.: US 7,265,733 B1
(45) Date of Patent: Sep. 4, 2007

(54) PLANAR ANTENNA HAVING A WIDE OPERATING BANDWIDTH

(75) Inventors: Tiao-Hsing Tsai, Yungho (TW); Chieh-Ping Chiu, Yunlin Shien (TW); Chih-Wei Liao, Yilan Shien (TW)

(73) Assignee: Quanta Computer Inc., Tao Yuan Shien (TW)

( * ) Notice: Subject to any disclaimer, the term of this patent is extended or adjusted under 35 U.S.C. 154(b) by 0 days.

(21) Appl. No.: 11/486,258

(22) Filed: Jul. 12, 2006

(30) Foreign Application Priority Data

Feb. 17, 2006 (TW) ..... 95105414 A

(51) Int. Cl.
*H01Q 1/36* (2006.01)

(52) U.S. Cl. ..... 343/895; 343/700 MS; 343/845; 343/846

(58) Field of Classification Search ..... 343/895, 343/700 MS, 845, 846, 767, 768, 824
See application file for complete search history.

(56) References Cited

U.S. PATENT DOCUMENTS 5,926,139 A * 7/1999 Korisch ..... 343/702
6,738,022 B2 * 5/2004 Klaavo et al. ..... 343/700 MS
6,756,946 B1 * 6/2004 Deng et al. ..... 343/742
6,980,154 B2 * 12/2005 Vance et al. ..... 343/700 MS

* cited by examiner

*Primary Examiner*—Tuyet Vo
(74) *Attorney, Agent, or Firm*—Ladas & Parry LLP

(57) ABSTRACT

A planar antenna includes a high frequency radiating element, a meandering low frequency radiating element, and an interconnecting element. The low frequency radiating element has an operating bandwidth which is lower than that of the high frequency radiating element. The interconnecting element interconnects the high frequency radiating element and the low frequency radiating element. A feeding point is provided on the high frequency radiating element and is distal from the interconnecting element. A grounding point is provided on either the interconnecting element, or the high frequency radiating element proximate to the interconnecting element.

15 Claims, 3 Drawing Sheets

PLANAR ANTENNA HAVING A WIDE OPERATING BANDWIDTH

CROSS-REFERENCE TO RELATED APPLICATION

This application claims priority of Taiwanese application no. 095105414, filed on Feb. 17, 2006.

BACKGROUND OF THE INVENTION

1. Field of the Invention

The invention relates to a planar antenna, more particularly to a planar antenna that has a relatively wide operating bandwidth.

2. Description of the Related Art

FIG. 1 illustrates a conventional planar inverted F-type antenna 1 that is mounted on a circuit board 10. The conventional planar inverted F-type antenna 1 includes a rectangular high frequency radiating element 11, a generally U-shaped low frequency radiating element 12, an interconnecting element 15, and feeding and grounding points 13, 14. The high frequency radiating element 11 has opposite first and second sides 111, 112. The interconnecting element 15 interconnects the high frequency radiating element 11 and the low frequency radiating element 12. The feeding and grounding points 13, 14 are provided on the high frequency radiating element 11, and are disposed proximate to the first side 111 and distal from the second side 112 of the high frequency radiating element 11.

The aforementioned conventional planar inverted F-type antenna 1 is disadvantageous in that, since the feeding and grounding points 13, 14 are disposed close to each other, the high frequency radiating element 11 has a relatively narrow operating bandwidth.

SUMMARY OF THE INVENTION

Therefore, the object of the present invention is to provide a planar antenna that has a relatively wide operating bandwidth.

According to one aspect of the present invention, a planar antenna comprises a high frequency radiating element, a meandering low frequency radiating element, an interconnecting element, and feeding and grounding points. The low frequency radiating element has an operating bandwidth which is lower than that of the high frequency radiating element. The interconnecting element interconnects the high frequency radiating element and the low frequency radiating element. The feeding point is provided on the high frequency radiating element. The grounding point is provided on the interconnecting element.

According to another aspect of the present invention, a planar antenna comprises a high frequency radiating element, a meandering low frequency radiating element, an interconnecting element, and feeding and grounding points. The high frequency radiating element has opposite first and second sides. The low frequency radiating element has an operating bandwidth which is lower than that of the high frequency radiating element. The interconnecting element interconnects the high frequency radiating element and the low frequency radiating element. The feeding point is provided on the high frequency radiating element, and is disposed proximate to the first side and distal from the second side of the high frequency radiating element. The grounding point is provided on the high frequency radiating element, and is disposed proximate to the second side and distal from the first side of the high frequency radiating element.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
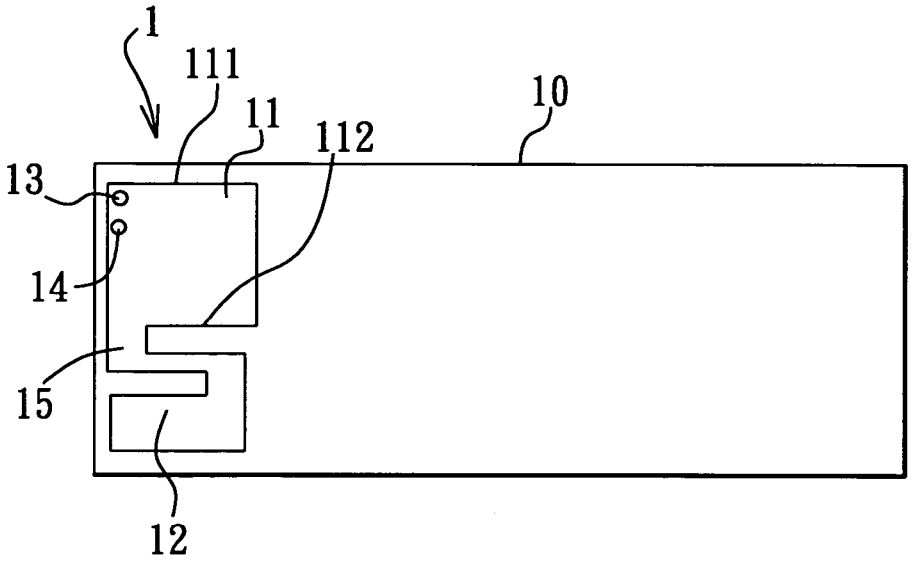
F I G. 1 PRIOR ART
FIG. 1 is a schematic view of a conventional planar inverted F-type antenna.

Before the present invention is described in greater detail, it should be noted that like elements are denoted by the same reference numerals throughout the disclosure.

Figure 2:
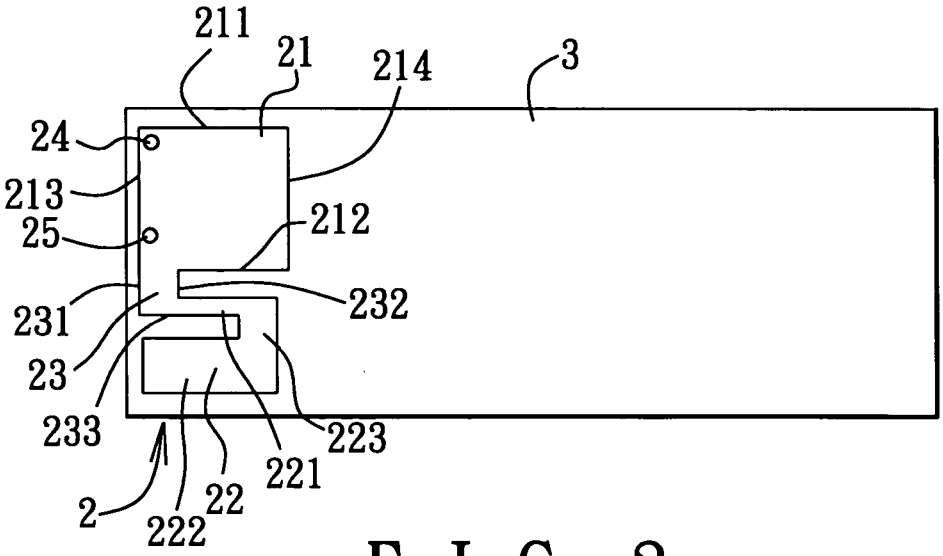
FIG. 2 is a schematic view of the first preferred embodiment of a planar antenna according to the present invention.

Referring to FIG. 2, the first preferred embodiment of a planar antenna 2 according to this invention is shown to include a high frequency radiating element 21, a low frequency radiating element 22, an interconnecting element 23, and feeding and grounding points 24, 25.

The planar antenna 2 of this embodiment is mounted on a circuit board 3.

The high frequency radiating element 21 is generally rectangular in shape, and has opposite first and second sides 211, 212, and opposite third and fourth sides 213, 214. In this embodiment, the high frequency radiating element 21 has an operating bandwidth that covers the DCS1800 bandwidth and the PCS1900 bandwidth.

The low frequency radiating element 22 is substantially u-shaped, and includes parallel first and second segments 221, 222, and a third segment 223 that interconnects the first and second segments 221, 222. In this embodiment, the low frequency radiating element 22 has an operating bandwidth that covers the GSM900 bandwidth.

The interconnecting element 23 interconnects the high frequency radiating element 21 and the low frequency radiating element 22. In particular, the interconnecting element 23 extends transversely from the second side 212 of the high frequency radiating element 21, has a width that is less than that of the second side 212 of the high frequency radiating element 21, and cooperates with the high frequency radiating element 21 to form an L-shape. In this embodiment, the interconnecting element 23 has a first side 231 that extends from the third side 213 of the high frequency radiating element 21, a second side 232 that is opposite to the first side 231 of the interconnecting element 23, and a third side 233 that extends between the first and second sides 231, 232 of the interconnecting element 23.

In this embodiment, the first segment 221 of the low frequency radiating element 22 extends transversely from the second side 232 of the interconnecting element 23, and has a side that extends from the third side 233 of the interconnecting element 23.

The feeding point 24 is provided on the high frequency radiating element 21, and is disposed adjacent to a corner defined by the first and third sides 211, 213 of the high frequency radiating element 21.

The grounding point 25 is provided on the high frequency radiating element 21, and is disposed adjacent to a corner defined by the second and third sides 212, 213 of the high frequency radiating element 21.

Figure 3:
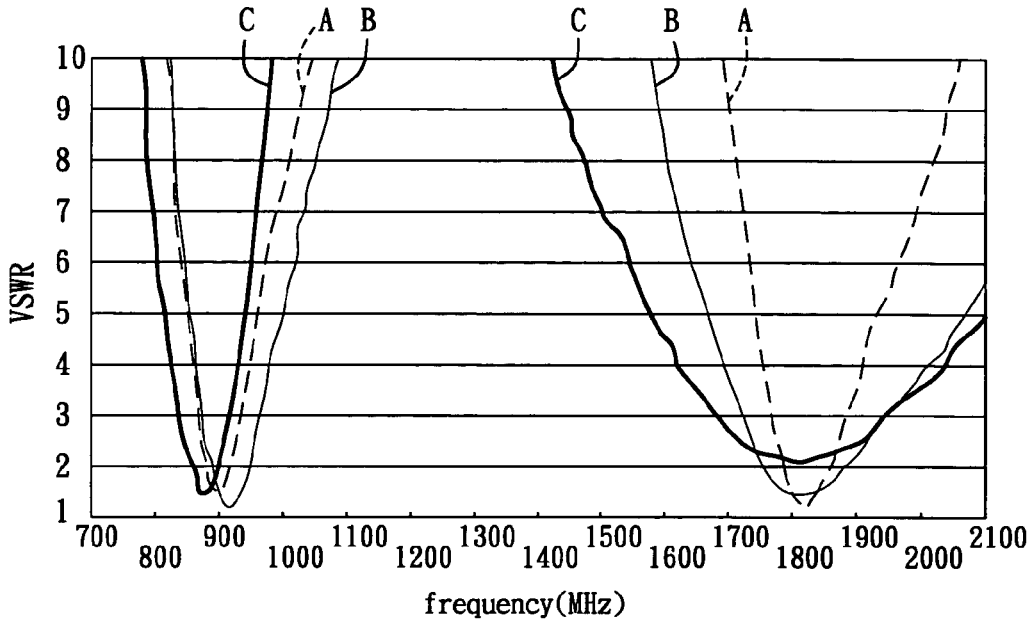
FIG. 3 is a plot to illustrate operating bandwidths of the preferred embodiment and the conventional planar inverted F-type antenna.

Based from experimental results, as illustrated in FIG. 3, the high frequency radiating element 21 of the planar antenna 2 of this embodiment has an operating bandwidth, as designated by line (B), which covers the bandwidth from 1720 MHz to 1950 MHz. It is noted that, a conventional planar antenna (see FIG. 1), which includes feeding and grounding points that are disposed proximate to the first side and distal from the second side of a high frequency radiating element thereof, has an operating band width, as designated by line (A), which covers the bandwidth from 1770 MHz to 1880 MHz. The high frequency radiating element 21 of the planar antenna 2 of this invention indeed has a relatively wide operating bandwidth.

Figure 4:
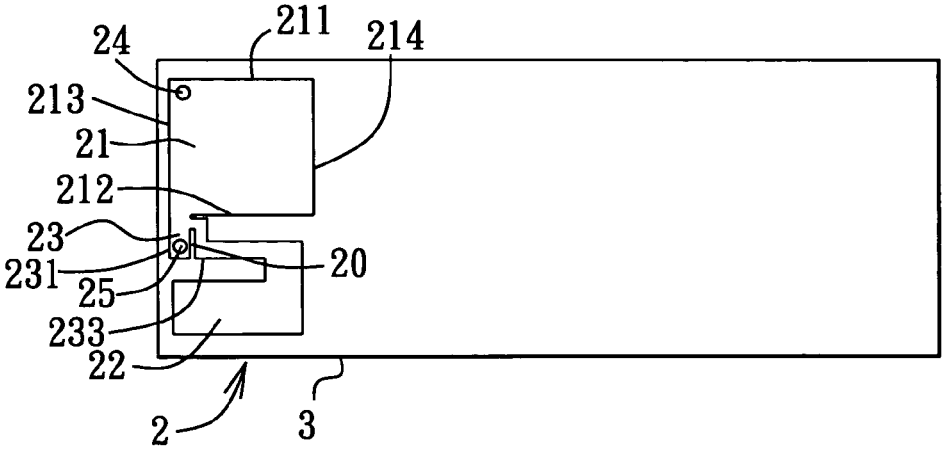
FIG. 4 is a schematic view of the second preferred embodiment of a planar antenna according to the present invention.

FIG. 4 illustrates the second preferred embodiment of a planar antenna 2 according to this invention. When compared to the previous embodiment, the grounding point 25 is disposed adjacent to a corner defined by the first and third sides 231, 233 of the interconnecting element 23. The planar antenna 2 further includes a first slot 20 that extends from the third side 233 of the interconnecting element 23 toward the high frequency radiating element 21.

Based from experimental results, as illustrated in FIG. 3, the high frequency radiating element 21 of the planar antenna 2 of this embodiment has an operating bandwidth, as designated by line (C), which covers the bandwidth from 1680 MHz to 1950 MHz.

Figure 5:
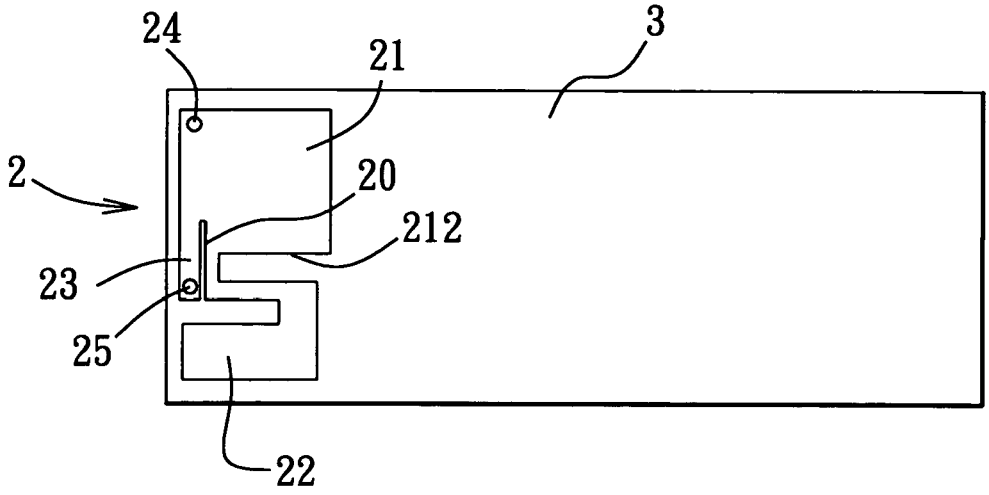
FIG. 5 is a schematic view of the third preferred embodiment of a planar antenna according to the present invention.

FIG. 5 illustrates the third preferred embodiment of a planar antenna 2 according to this invention. When compared to the second embodiment, the first slot 20 further extends into the high frequency radiating element 21.

Figure 6:
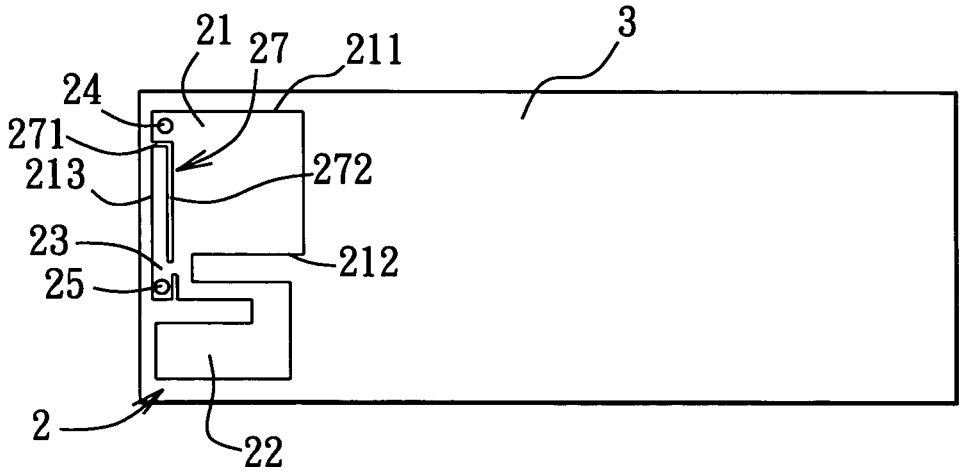
FIG. 6 is a schematic view of the fourth preferred embodiment of a planar antenna according to the present invention.

FIG. 6 illustrates the fourth preferred embodiment of a planar antenna 2 according to this invention. When compared to the second embodiment, the planar antenna 2 further includes a second slot 27 that has an L-shape. In this embodiment, the second slot 27 has a first segment 271 that extends from the third side 213 toward the fourth side 214 of the high frequency radiating element 21, and a second segment 272 that extends from the first segment 271 into the interconnecting element 23.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A planar antenna, comprising:

a high frequency radiating element;

a meandering low frequency radiating element having an operating bandwidth which is lower than that of said high frequency radiating element;

an interconnecting element interconnecting said high frequency radiating element and said low frequency radiating element;

a feeding point provided on said high frequency radiating element; and a grounding point provided on said interconnecting element.

2. The planar antenna as claimed in claim 1, wherein said high frequency radiating element has an operating bandwidth that covers the DCS1800 bandwidth and the PCS1900 bandwidth.

3. The planar antenna as claimed in claim 1, wherein said low frequency radiating element has an operating bandwidth that covers the GSM900 bandwidth.

4. The planar antenna as claimed in claim 1, wherein said high frequency radiating element has an operating bandwidth that covers a band from 1680 MHz to 1950 MHz.

5. The planar antenna as claimed in claim 1, wherein said low frequency radiating element has an operating bandwidth that covers a band from 850 MHz to 910 MHz.

6. The planar antenna as claimed in claim 1, wherein said high frequency radiating element is generally rectangular in shape, and has opposite first and second sides, said feeding point being disposed proximate to said first side of said high frequency radiating element, said interconnecting element extending transversely from said second side of said high frequency radiating element, and having a width which is less than that of said second side of said high frequency radiating element.

7. The planar antenna as claimed in claim 6, wherein said high frequency radiating element further has a third side, said feeding point being disposed adjacent to a corner defined by said first and third sides of said high frequency radiating element.

8. The planar antenna as claimed in claim 7, wherein said interconnecting element has a first side that extends from said third side of said high frequency radiating element.

9. The planar antenna as claimed in claim 8, wherein said interconnecting element further has a second side that is opposite to said first side thereof, said low frequency radiating element being substantially U-shaped, and including parallel first and second segments, said first segment of said low frequency radiating element extending transversely from said second side of said interconnecting element.

10. The planar antenna as claimed in claim 9, wherein said interconnecting element further has a third side extending between said first and second sides thereof, said first segment of said low frequency radiating element having a side that extends from said third side of said interconnecting element.

11. The planar antenna as claimed in claim 9, wherein said interconnecting element further has a third side extending between said first and second sides thereof, said grounding point being disposed proximate to said third side of said interconnecting element.

12. The planar antenna as claimed in claim 11, wherein said grounding point is disposed adjacent to a corner defined by said first and third sides of said interconnecting element.

13. The planar antenna as claimed in claim 9, wherein said interconnecting element further has a third side extending between said first and second sides thereof, said planar antenna further comprising a first slot extending from said third side of said interconnecting element toward said high frequency radiating element.

14. The planar antenna as claimed in claim 13, wherein said high frequency radiating element further has a fourth side opposite to said third side thereof, said planar antenna further comprising an L-shaped second slot having a first segment that extends from said third side toward said fourth side of said high frequency radiating element, and a second segment that extends from said first segment into said interconnecting element.

15. The planar antenna as claimed in claim 13, wherein said first slot further extends into said high frequency radiating element.

* * * * *